US005660704A

United States Patent [19]

Murase

[11] Patent Number: 5,660,704

[45] Date of Patent: Aug. 26, 1997

[54] PLATING METHOD AND PLATING SYSTEM FOR NON-HOMOGENOUS COMPOSITE PLATING COATING

[75] Inventor: Yasuyuki Murase, Iwata, Japan

[73] Assignee: Yamaha Hatsudoki Kabushiki Kaisha, Shizuoka-ken, Japan

[21] Appl. No.: 391,505

[22] Filed: Feb. 21, 1995

[30] Foreign Application Priority Data

Feb. 21, 1994 [JP] Japan ..... 6-022640

[51] Int. Cl.[6] ..... C25D 15/00

[52] U.S. Cl. ..... 205/109; 205/131

[58] Field of Search ..... 205/109, 131; 204/229, 272, 275

[56] References Cited

U.S. PATENT DOCUMENTS

| | | | |
|---|---|---|---|
| 4,085,010 | 4/1978 | Ishimori | 205/109 |
| 4,303,481 | 12/1981 | Mortier | 205/148 |
| 4,399,019 | 8/1983 | Kruper | 204/212 |
| 4,681,817 | 7/1987 | Shinada | 428/549 |
| 4,728,408 | 3/1988 | Palazzolo | 204/129 |
| 5,266,181 | 11/1993 | Matsumura | 205/109 |
| 5,540,829 | 7/1996 | Mase | 205/109 |

FOREIGN PATENT DOCUMENTS

| | | |
|---|---|---|
| 142068 | 7/1984 | Japan . |
| 143596 | 7/1986 | Japan . |
| 1200410 | 7/1970 | United Kingdom . |

OTHER PUBLICATIONS

J. Zahavi, et al. "Electrodeposited Nickel Composites Containing Diamond Particles," *Plating and Surface Finishing*, Feb. 1983.

*Primary Examiner*—T. Tung
*Assistant Examiner*—Brendan Mee
*Attorney, Agent, or Firm*—Knobbe, Martens, Olson & Bear, LLP

[57] ABSTRACT

A method for forming a plating coating having a non-homogeneous distribution of a dispersed substance in the outward direction, on a work such as a cylinder of an internal combustion engine block, is characterized in the steps of changing the plating liquid flow rate and/or the electric current density to a degree sufficient to change the amount of a dispersed substance at intervals or continuously in a plating coating, so that the amount of the dispersed substance in the plating coating is changed in the outward direction at intervals or continuously.

14 Claims, 8 Drawing Sheets

PLATING METHOD AND PLATING SYSTEM FOR NON-HOMOGENOUS COMPOSITE PLATING COATING

BACKGROUND

1. Field of the Invention

This invention relates to a plating method and plating system in which a plating liquid containing a dispersed substance-forming material flows between a surface of a work to be plated and an electrode and, in particular, to such a method and system allowing for forming a plating coating having a non-homogeneous distribution of a dispersed substance, especially useful in nickel plating of the interior surfaces of cylinders of internal combustion engine blocks.

2. Background of the Art

A particular plating in which a dispersed substance-forming material is used, so-called composite plating, is hitherto known as one of the plating methods which can provide a plating layer having excellent lubricity and frictional properties. Composite plating is conducted advantageously in plating the interior surfaces of cylinders of internal combustion engine blocks.

In composite plating, various requirements for plating layers cannot be satisfied in some cases. For example, adhesion between a composite plating layer and a work is impaired when using one composite plating layer in which a dispersed substance is formed at an amount sufficient to obtain satisfactory lubricity or frictional properties. To improve adhesion between a composite plating layer and a work, an attempt is known, in which a work and an electrode are immersed in a plating liquid containing a dispersed substance-forming material, which is stored in a tank, a constant voltage is impressed therebetween at a low electric current density (e.g., 100 $Ndm^2$), and then a constant voltage is impressed therebetween at an electric current density (e.g., 200–300 $Ndm^2$) higher than the initial density, whereby the first plating layer contains a dispersed substance 0.5% by weight less than that of the second plating layer which contains 1.5–3.5% by weight (fluctuation due to the dispersion of the contents of the plating liquid) so as to indirectly strengthen adhesion between the second plating layer and the surface of a work. However, based on the above control, the maximum difference between the first plating layer and the second plating layer in the amount of a dispersed substance would be approximately only 0.5%, and it is impossible to enlarge the difference more than such since it is not in practice to further decrease the electric current density to decrease the amount of a dispersed substance in the first plating coating due to too slow a deposition speed, and it is also not in practice to further increase the electric current density to increase the amount of a dispersed substance in the second plating layer due to serious impairment of the quality of the layer (metal hydroxide or oxide, not metal itself, tends to be educed on a work). Thus, the first plating layer cannot be sufficient to improve adhesion of the second plating layer due to similar dispersed substance contents between the first and second plating layers, and thus the thickness of the first plating layer is limited to 1 μm or less since no further effects or even adverse effects are expected. Hitherto, a composite plating layer containing a dispersed substance and a plating coating composed of a base plating layer containing significantly less dispersed substance, which are stacked on the surface of a work and which are formed from the same metal base plating liquid, has not been achieved.

As described above, immersing a work in a plating bath to plate the work is commonly conducted. In order to improve productivity of the common plating treatment, a technology to speed up plating processes by impressing a voltage between the surface of a work to be plated and an electrode while permitting a plating liquid to flow therebetween has been recently developed. However, even if the high speed plating method is adopted, plural plating layers composed of a base plating layer and a composite plating layer has not been successful.

SUMMARY OF THE INVENTION

In order to form plural plating layers, the use of plural plating liquids, e.g., a plating liquid containing no dispersed substance-forming material and that containing a dispersed substance-forming material, can be conceived. For example, first, a base plating layer is formed on the surface of a work in a plating bath containing no dispersed substance-forming material, and then the work is transferred to a plating bath containing a dispersed substance-forming material where a composite plating layer is formed on the base plating layer. However, transfer of a work which accompanies plating treatment is very disadvantageous in terms of productivity, facilities and cost. In this regard, even if the high speed plating method is adopted, in the case of forming plural plating layers, the number of plating baths which is the same as that of the plating layers must be used, and thus productivity, facilities and the like cannot be fully improved.

The present invention has exploited a high speed plating approach to form a plating coating having a non-homogeneous distribution of a dispersed substance, which is technically composed of a base plating layer and a composite plating layer. An objective of the present invention is to provide a method and a system for forming a plating coating having a non-homogeneous distribution of a dispersed substance to obtain composite characteristics such as lubricity, frictional properties and adhesion strength, using a single plating liquid containing a dispersed substance-forming material.

Namely, one important aspect of the present invention is a method for forming a plating coating having a non-homogeneous distribution of a dispersed eutectoid substance, said distribution being changed in the outward direction in which the plating coating is formed, comprising the steps of (a) permitting a plating liquid containing a dispersed substance-forming material to flow between a surface of a work to be plated and an electrode; (b) impressing a voltage between said work and electrode to give an electric current density therebetween so as to initiate deposition of a plating coating on the surface of said work; and (c) changing the plating liquid flow rate and/or the electric current density at intervals or continuously to a degree sufficient to change the amount of a dispersed substance at intervals or continuously in the outward direction in a plating coating, thereby forming a plating coating in which a distribution of the dispersed substance is changed in the outward direction. A change in the amount of a dispersed substance in the outward direction in the plating coating can be given at intervals or continuously. Surprisingly, by controlling the plating liquid flow rate and/or the electric current density, especially the plating liquid flow rate, it is possible to form a plating coating deposited on the surface of a work to be plated, said plating coating having a non-homogeneous distribution a dispersed substance in the outward direction, simply using a single plating bath containing a dispersed substance-forming material without transferring the work to another plating bath.

In the above method, when the plating liquid flow rate in step (a) and the electric current density in step (b) are sufficiently high to prevent formation of a dispersed substance near the surface of the work, and those in step (c) are sufficiently low to promote formation of a dispersed substance near the surface of the plating coating, the resulting plating coating are technically composed of a composite plating layer containing a dispersed substance and a base plating layer containing significantly less dispersed eutectoid substance, said composite plating layer being deposited on the base plating layer (the boundary therebetween is not necessarily clear), thereby highly improving adhesion strength between the plating layer and the surface of the work without impairing lubricity and frictional properties. The use of plural plating liquids can be entirely eliminated.

Further in the above method, when a nickel plating liquid as the plating liquid and silicon carbide as the dispersed substance-forming material are used, the layer near the surface of the work is a nickel plating layer containing significantly less dispersed silicon carbide than that of the subsequent layer, and said subsequent layer is a Ni—P matrix plating layer containing a sufficient amount of a dispersed silicon carbide. If the plating liquid further contains phosphorus, the resulting plating layer will be harder. From this point of view, plating the inner surfaces of cylinders of internal combustion engine blocks using the present method is startlingly effective.

Although the above method can be adapted for a non-circulation plating system or an immersing plating system, it is very advantageous to adapt the present method for a circulation plating system (a high speed plating system).

Another important aspect of the present invention is to provide a plating system for forming a plating coating having a non-homogeneous distribution of the dispersed substance, said distribution being changed in the outward direction in which the plating coating is formed, comprising (a) a plating bath containing a plating liquid, said liquid containing a dispersed substance-forming material; (b) a workstation comprising an electrode, means for supporting a work, and means for impressing a voltage between the electrode and the work at an electric current density; (c) means for permitting the plating liquid to flow between a surface of the work to be plated and the electrode at a plating liquid flow rate; (d) means for changing the plating liquid flow rate; (e) means for changing the electric current density; (f) means for controlling the means for changing the plating liquid flow rate and the means for changing the electric current density at a time interval so as to change the amount of a dispersed substance in a plating coating; and (g) means for measuring the time interval and inputting the time information into the means for control. Based on the above system, the aforesaid plating method can be efficiently conducted.

DETAILED DESCRIPTION OF THE PREFERRED EMBODIMENT

Figure 1:
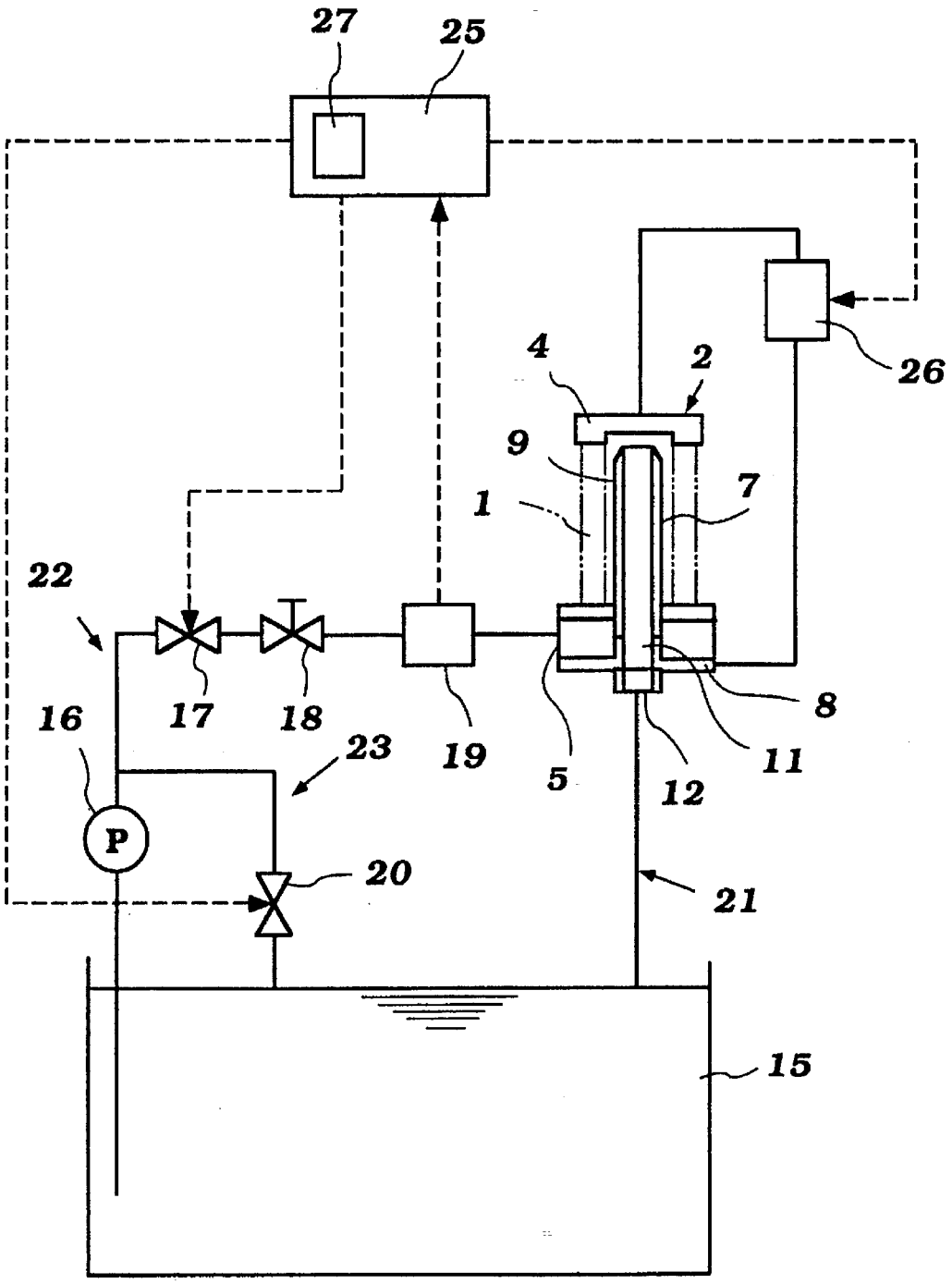
FIG. 1 is a schematic view illustrating a piping system and control system of a plating system according to the present invention.

In the present invention, the distribution of a dispersed substance contained in a deposited plating coating is adjusted by controlling the plating liquid flow rate and/or the electric current density based on timing. In other words, despite the fact that concentration of a dispersed substance-forming material present in a plating liquid is substantially constant, the distribution of a dispersed substance formed in a plating coating can be changed in the outward direction in which the plating coating is formed, thereby rendering the distribution of a dispersed substance non-homogeneous in the outward direction. Based on the above principle, the present invention can include various embodiments without restrictions, although some embodiments which will be described below are highly advantageous.

In the present invention, the distribution of a dispersed substance can be changed at intervals or continuously in the outward direction. If the change is performed at intervals, the plating coating will be composed of plural plating layers, each having a different amount of a dispersed substance, i.e., different characteristics such as lubricity, frictional properties and adhesion strength. That is, a plating coating can be composed of two or more plating layers, normally two to four plating layers, depending on the intended use of a work, the shape and material of a work, the kind of plating liquid and so forth. Further, the amount of a dispersed substance in each plating layer can be increased in steps, decreased in steps, or increased and decreased alternately in the outward direction, depending on the characteristics required of a plating coating. However, each boundary between plating layers is not necessarily clear. In other words, the amount of a dispersed substance can be changed continuously through a plating coating, based on the present invention. In the case of a plating coating in which the distribution of a dispersed substance is graded in the outward direction, the plating coating can be regarded simply as one plating layer, in which gradation is given to the distribution of the dispersed substance in the outward direction. Alternatively, the plating coating can be technically regarded as a stacked layer composed of infinitely thin plating layers, each having a constant distribution in the outward direction. A plating coating having a dispersed distribution changed continuously and a plating coating having a dispersed distribution changed at intervals can be combined without any obstacle.

For example, a first plating layer is formed to contain significantly less dispersed substance (a base plating layer) than that of a second layer, thereby rendering the layer high in adhesion strength, and the second plating layer is formed to contain a dispersed eutectoid (a composite plating layer), thereby rendering the layer high in lubricity and frictional properties. Further, the second plating layer can be formed to contain the dispersed eutectoid in such a way that the amount of the dispersed eutectoid is high near the outer surface and low near the first layer, whereby lubricity, frictional properties and adhesion strength of the plating coating can be improved. As above, a non-homogeneous plating coating is conspicuously advantageous. In any case, by enlarging the difference between the upper (near the outer surface) and lower (near the surface of a work) plating layers in the amount of a dispersed substance to 1.0% by weight or more, adhesion between the upper plating layer and the surface of the work can be significantly improved. The upper plating layer (composite plating layer) has normally a thickness of 10–100 μm (prior to honing treatment), and the lower plating layer (base plating layer) has normally a thickness of 2–100 μm. In particular, when the base plating layer has a thickness of 2 μm or more, adhesion strength can further be ensured.

In the present invention, a plating liquid is not restricted and selected depending on the intended use of a work and so on. For example, although engine and cylinders are often formed by chrome plating, it is desirable to use a plating coating which contains a dispersed substance and phosphorus and, in particular, a Ni—P—SiC plating coating which contains nickel and phosphorus and in which the silicon carbon is dispersed. This plating provides excellent lubricity and frictional properties. Thus, in such a case, a plating liquid would be a nickel plating liquid which contains a dispersed substance-forming material and preferably phosphorus. Phosphorus contributes to hardness of a plating layer. In this regard, a nickel sulfamate bath or a nickel sulfate bath having a concentration of the main component of 300–700 grams per liter can be used as the plating bath in which the phosphorus concentration is preferably 0.1–0.3 g/l. As a dispersed substance-forming material, silicon carbide can be preferably contained at an amount sufficient to form approximately 1.5–3.5 percent by weight of dispersed silicon carbide in a plating layer, in view of excellent lubricity and frictional properties. In addition, by incorporating sodium in a plating bath at a concentration of 1.0–3.5 g/l or more, the amount of silicon carbide eutectoid and the phosphorus content can both be increased, even though the plating deposition speed is increased. Other conditions such as temperature and pH of plating liquid are normally 65°–80° C. and pH 3.0–4.5. In addition to a nickel bath, a chrome bath is also usable, especially for plating the inner surface of an aluminum cylinder of a reciprocating compressor or a lawn mower.

As a work to be plated, various materials and shapes can be treated. The present method is, however, suitable for nickel plating on the interior surfaces of cylinders of internal combustion engine blocks (especially a car engine), since the interior surface especially requires good lubricity, frictional properties and adhesion strength, and a base plating layer cannot satisfy the requirements. Any other work which requires a plating coating having complex characteristics can be treated.

In the present invention, the amount of dispersed substance contained at any given depth of a deposited plating coating is adjusted by controlling the plating liquid flow rate and/or the electric current density based on timing (preferably by controlling both), not by using plural plating liquids. The plating liquid flow rate and the electric current density should be adjusted so as to form the desired plating coating composed of plural plating layers, each having a different amount of a dispersed substance, or a plating layer having a graded distribution of a dispersed substance in the outward direction, and the optimum conditions depend on the intended use of a work, the kind of plating liquid, the material and shape of a work, the structure of a plating apparatus and so forth (see Examples 4–6 below). For example, the plating liquid flow rate relative to the surface to be plated is changed normally within the range of 1.0 to 7.0 meters per second (preferably 2.0 to 6.0 meters per second) and the electric current density applied is changed normally within the range of 20 to 400 $Ndm^2$ (preferably 50 to 300 $Ndm^2$). Although the plating liquid flow rate and the electric current density both contribute to the change in the amount of a dispersed substance in the plating coating, the change in the plating liquid flow rate is more effective than the change in the electric current density in changing the amount of a dispersed substance in the plating coating. The change in the electric current density contributes rather to the deposition speed of plating coating. For example, when the electric current densities are 100 $A/dm^2$, 150 $A/dm^2$, 200 $A/dm^2$, and 300 $A/dm^2$, the deposition speeds are normally 20–25 μm/min, 30–35 μm/min, 40–45 μm/min, and 60–65 μm/min, respectively. When the plating liquid flow rate is high, the electric current density can be high without impairing the quality of the plating coating (see Example 3 below). If the flow rate and the electric current density are sufficiently high (e.g., 4.0–5.0 m/sec and 200–300 $A/dm^2$), a plating coating containing substantially no or few dispersed substance will be formed at a deposition speed of approximately 40–65 μm/min, while if the flow rate and the electric current density are sufficiently low (e.g., 2.0–3.0 m/sec and 50–100 $A/dm^2$), a plating coating containing a significant amount of a dispersed substance will be formed at a deposition speed of approximately 20–25 μm/min. Interestingly, the above control of the electric current density is the reverse of that in the immersing plating systems. That is, the electric current density is increased to decrease the amount of a dispersed substance in the present invention, while the electric current density is decreased to decrease the amount of a dispersed substance in the prior art.

In the above, either the flow rate or the electric current density can be constant within the range of 1.0–3.0 m/sec and 20–300 $A/dm^2$ during a plating period. A change in the amount of a dispersed substance will basically correspond to a change in the plating liquid flow rate and the electric current density, especially a change in the plating liquid flow rate. The present method is advantageously applied to a high speed plating system, i.e., a circulation plating system.

EXAMPLE 1: Plating Apparatus

FIG. 1 is a schematic view illustrating a piping system and control system of a plating apparatus according to the present invention. As depicted in the Figure, a reservoir tank 15 and a workstation 2 are connected to each other via a liquid feed pipe 22 and a treating liquid recovery pipe 21. A pump 16 is placed in the liquid feed pipe 22. The upstream end of the liquid feed pipe 22 leads to the reservoir tank 15 through the pump 16, and the downstream end of the liquid feed pipe 22 is connected to a treating liquid feed path 5 of the workstation 2. Further, a by-pass pipe 23 is placed right after the pump 16 downstream, and the by-pass pipe 23 leads to the reservoir tank 15. The upstream end of the treating liquid recovery pipe 21 is connected to a treating liquid discharge path 11 of the workstation 2 via a connection pipe 12, and the downstream end of the pipe 21 leads to the reservoir tank 15. The liquid feed pipe 22 and the by-pass pipe 23 are provided with automatic valves 17 and 20, respectively. The liquid feed pipe 22 is also provided with a manual valve 18 and a flow rate sensor 19 downstream after the automatic valve 17. The automatic valves 17 and 20, and the flow rate sensor 19 are hooked up to a controller 25 which controls the plating treatment over all. In plating operation, the flow rate between a surface of a work 1 to be plated and an electrode 7, i.e., an outer passage 9, is controlled by opening and shutting the automatic valves 17 and 20 based on an output signal from the flow rate sensor 19. In other words, means for changing the plating liquid flow rate comprises the automatic valves 17 and 20, and the flow rate sensor 19 in this apparatus. A seal portion 4 electrically connected to the work 1 (see Example 2) and a holder portion 8 electrically connected to the electrode 7 (see Example 2) of the workstation 2 are electrically connected to a rectifier 26 connecting to an alternating current power source (not shown), and the rectifier 26 is hooked up to the controller 25. In plating operation, the rectifier 26 sends out a rectified electric current to the electrode 7 via the holder 8, and the intensity of the current can be set and changed by the controller 25, whereby the electric current density impressed between the electrode 7 and the work 1 can be controlled. Thus, the rectifier 26 also functions as means for changing the electric current density in this apparatus. The controller 25 is provided with a timer 27 as means for measuring a time interval and inputting the time information into the controller 25, thereby controlling timely operation.

EXAMPLE 2: Workstation

Figure 2:
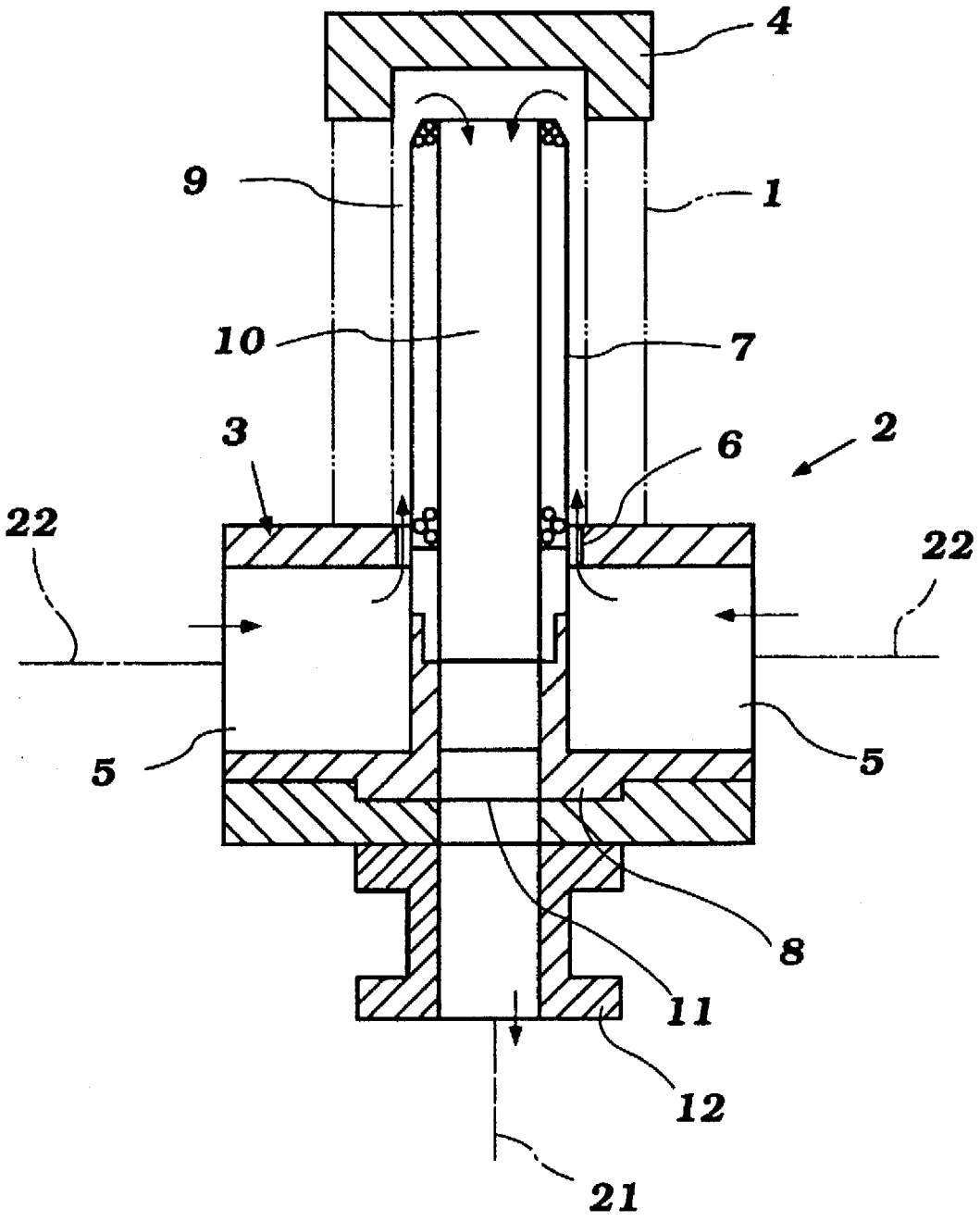
FIG. 2 is a vertical cross-sectional view showing one embodiment of a workstation adapted for a plating system according to the present invention.

FIG. 2 is a vertical cross-sectional view showing one embodiment of a workstation adapted for a plating system depicted in FIG. 1. A cylindrical work 1 such as a cylinder of an internal combustion engine block is placed in a workstation 2, in which the inner surface of the work 1 will be plated. The work 1 is fixed on a work-supporting portion 3 which is formed on an upper part of the workstation 2, and the opening edge of the work 1 is sealed with a seal portion 4. The work 1 is electrically insulated from the work-supporting portion 3 using a material used as both an insulator and a seal portion placed therebetween. The seal portion 4 is made from conductive material, and functions as a connection terminal when electrified. The work-supporting portion 3 forms a treating liquid feed path 5 in the horizontal direction, and is provided with an opening 6 which communicates to the treating liquid feed path 5 at the location where the lower opening of the work 1 will be placed. When the work 1 is fixed on the work-supporting portion 3, the location of the lower opening of the work 1 matches that of the opening 6, whereby both the peripheries of the openings are fastened each other. The workstation 2 is also provided with an electrode 7 at the location where the inner surface of the work 1 will be placed. The electrode 7 is cylindrically formed; and connected to a holder 8 which is formed on the lower wall of the workstation 2, wherein the electrode 7 protrudes from the treating liquid feed path 5 and the opening 6 upward. The holder 8 is made from a conductive material, and also functions as a connection terminal. When the work 1 is fixed on the work-supporting portion 3, the electrode 7 is inserted into the inner portion of the work 1, and the upper edge of the electrode 7 reaches near the upper edge of the work 1. Accordingly, in the inner portion of the work 1, an outer cylindrical opening passage 9 and an inner cylindrical opening passage 10 which communicate to each other are formed, and the passage 9 leads to the treating liquid feed path 5. Through the holder 8 and the lower wall of the work 1, a treating liquid discharge path 11 is formed which communicates to the inner cylindrical passage 10. The treating liquid discharge path 11 is connected to the treating liquid recovery pipe 21 via a connection pipe 12 as shown in Example 1.

EXAMPLE 3: Relationship between Amount of Dispersed Substance vs Plating Liquid Flow Rate, Electric Current Density vs Plating Liquid Flow Rate, and Deposition Speed vs Electric Current Density As shown in FIGS. 1 and 2, a work 1 is fixed on a workstation 2, and a plating liquid is introduced into the workstation 2 and circulated in an apparatus via a piping system, while a voltage is impressed between the work 1 and an electrode 7, and the inner cylindrical surface of the work 1 will be plated. In detail, the plating liquid which is introduced to a treating liquid feed path 5 through a liquid feed pipe 22 flows into an outer cylindrical passage 9 which is defined by the outer surface of the electrode 7 and the inner cylindrical surface of the work 1, and then flows into an outer cylindrical passage 10 defined by the inner cylindrical surface of the electrode 7 via the upper edge of the work 1. The plating liquid further flows into a treating liquid recovery pipe 21 through a treating liquid discharge path 11 and a connection pipe 12, and then is returned to a reservoir tank 15. In this manner, the plating liquid is circulated, and a voltage is impressed between the work 1 and the electrode 7 while the plating liquid flows along the inner cylindrical wall of the work to be plated, thereby completing plating of the inner surface of the work.

Using the above apparatus, plating was conducted on the interior surfaces of cylinders of internal combustion engine blocks under the various conditions which will be described. As a plating liquid, a nickel sulfamate bath (500 or 300–700 g/l of $Ni(SO_3.NH_2)_2$, 10–30 g/l of $NiCl_2$, 30 g/l of $H_3BO_3$, 0.1–0.3 g/l of P, 1.0–3.5 g/l of Na, 1.5–3.5% by weight of silicon carbide as a dispersed substance-forming material, and the remainder consisting of water; pH 3.0–4.5, preferably pH 4.0–4.5; bath temperature 65°–80° C.) was used. Alternatively, a nickel sulfate bath (450 or 300–700 g/l of $NiSO_2.6H_2O$, 60 g/l of $NiCl_2.6H_2O$, 30 g/l of $H_3BO_3$, 0.1–0.3 g/l of P, 1.0–3.5 g/l of Na, 1.5–3.5% by weight of silicon carbide as a dispersed substance-forming material, the remainder consisting of water; pH 3.0–4.5, preferably pH 4.0–4.5; bath temperature 65°–80° C.) can be used.

Figure 3:
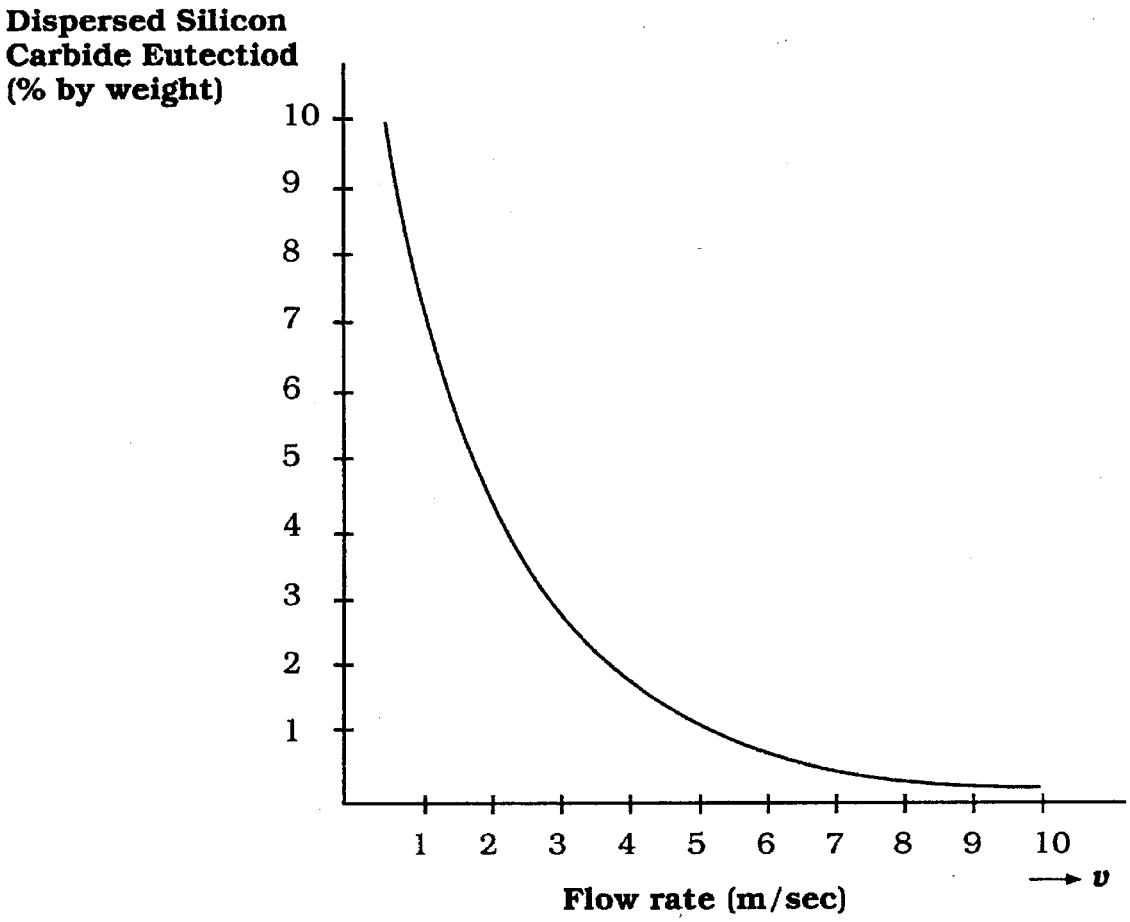
FIG. 3 is a graph showing the relationship between the amount of a dispersed substance in a plating coating and the plating liquid flow rate.
Figure 4:
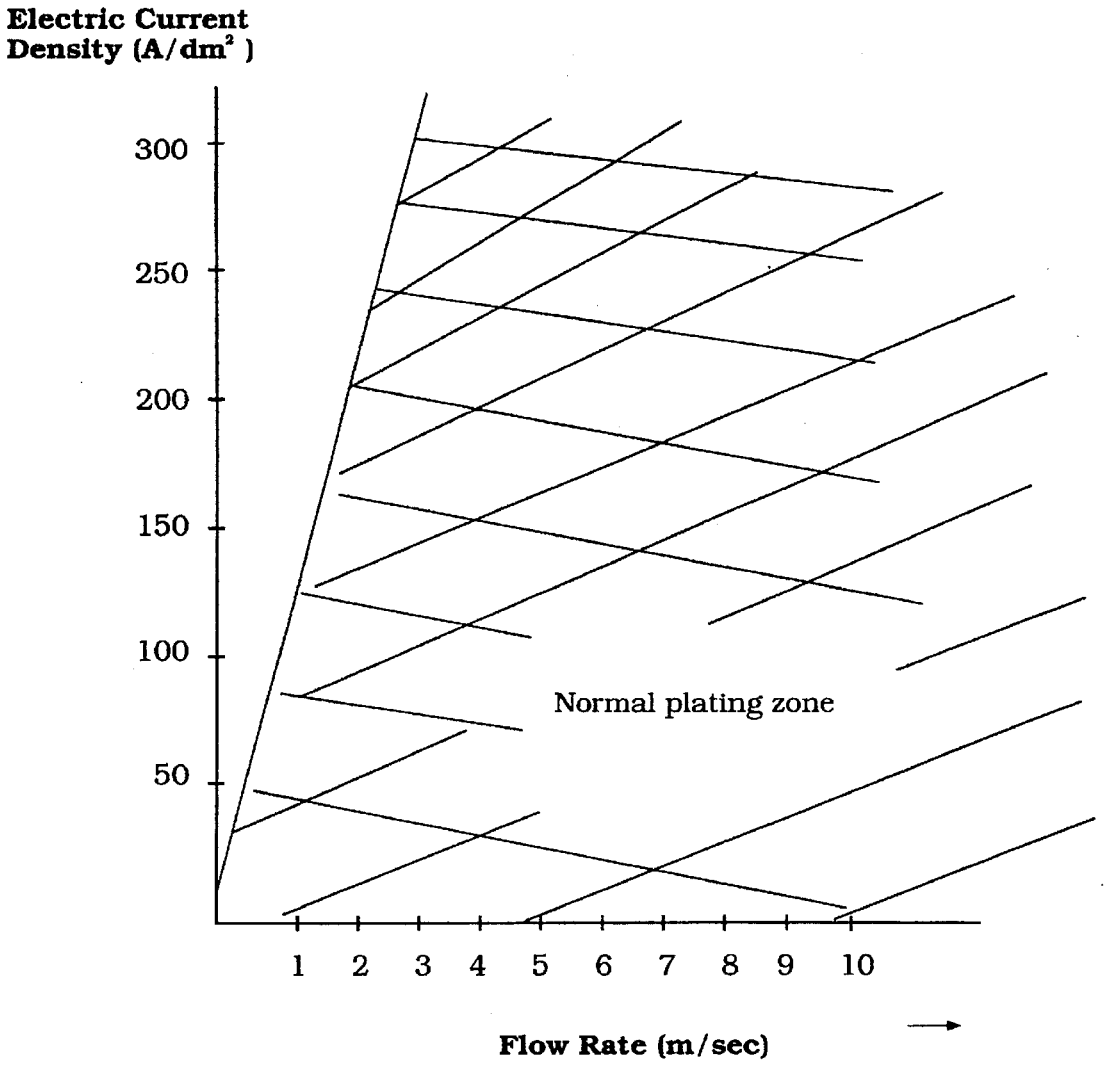
FIG. 4 is a graph showing the relationship between the electric current density and the plating liquid flow rate to form a normal plating coating.
Figure 5:
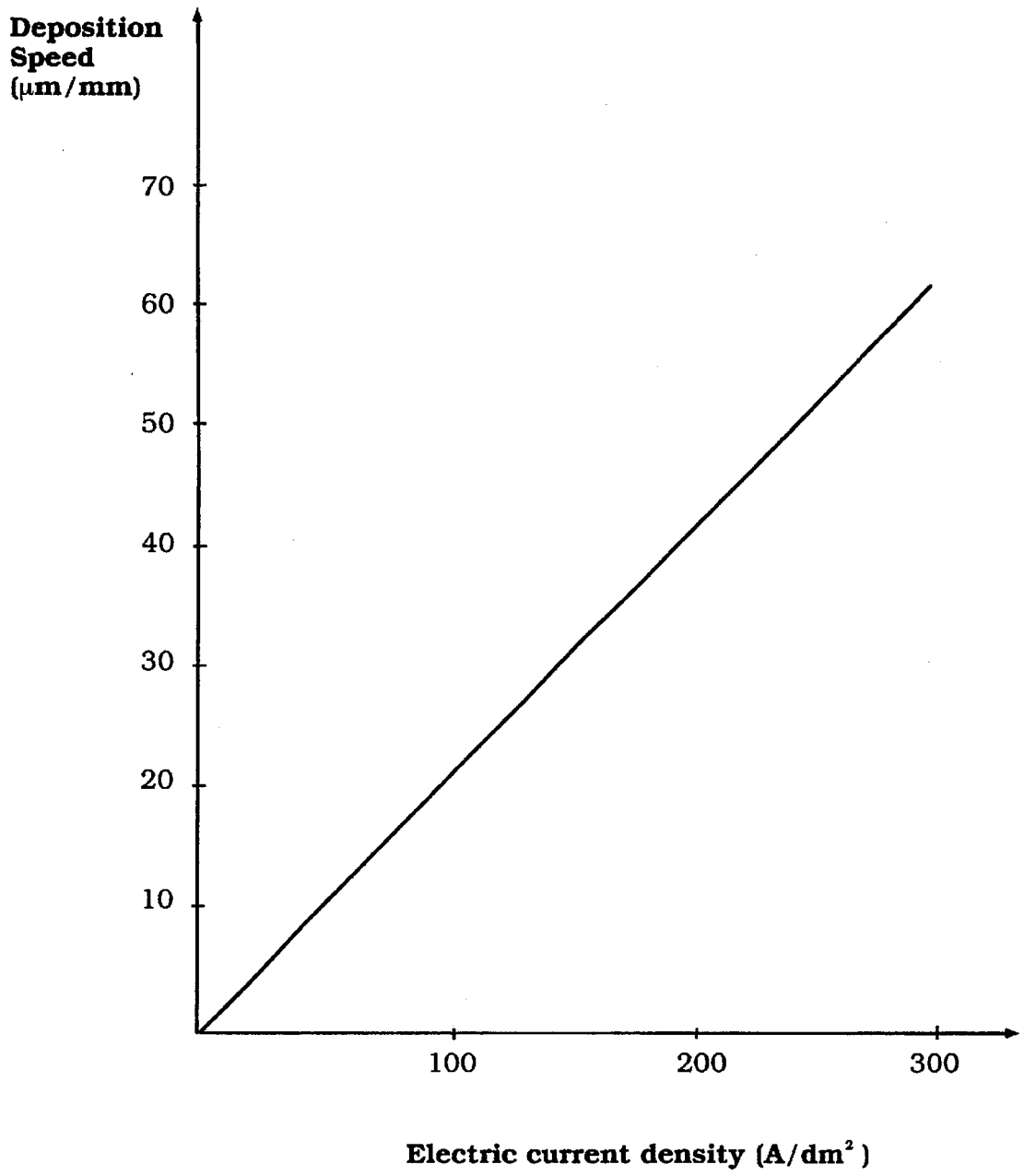
FIG. 5 is a graph showing the relationship between the deposition speed and the electric current density.

FIG. 3 is a graph showing the relationship between the amount of a dispersed substance in a plating coating and the plating liquid flow rate when the electric current density was 200 $A/dm^2$. As indicated by the graph, as the plating liquid flow rate is increased, the amount of a dispersed substance is decreased in an exponential manner. Although the electric current density also contributed to the change in the amount of a dispersed silicon carbide in the same manner, the degree of the change in the amount was not as high as that observed in the plating liquid flow rate (data not shown). FIG. 4 is a graph showing the relationship between the electric current density and the plating liquid flow rate to form a normal plating coating. When the electric current density was higher than the level indicated by the line in the graph, nickel was not educed on the surface of the work, and nickel hydroxide or nickel oxide was educed thereon, resulting in an impaired plating coating. FIG. 5 is a graph showing the relationship between the deposition speed and the electric current density. As indicated by the graph, the deposition speed is proportional to the electric current density. Within the range shown in the graph of FIG. 4, the electric current density can be increased to promote the deposition of plating coating. Based on these graphs, plating conditions can be appropriately selected.

EXAMPLE 4: Two Layer Plating

Figure 6:
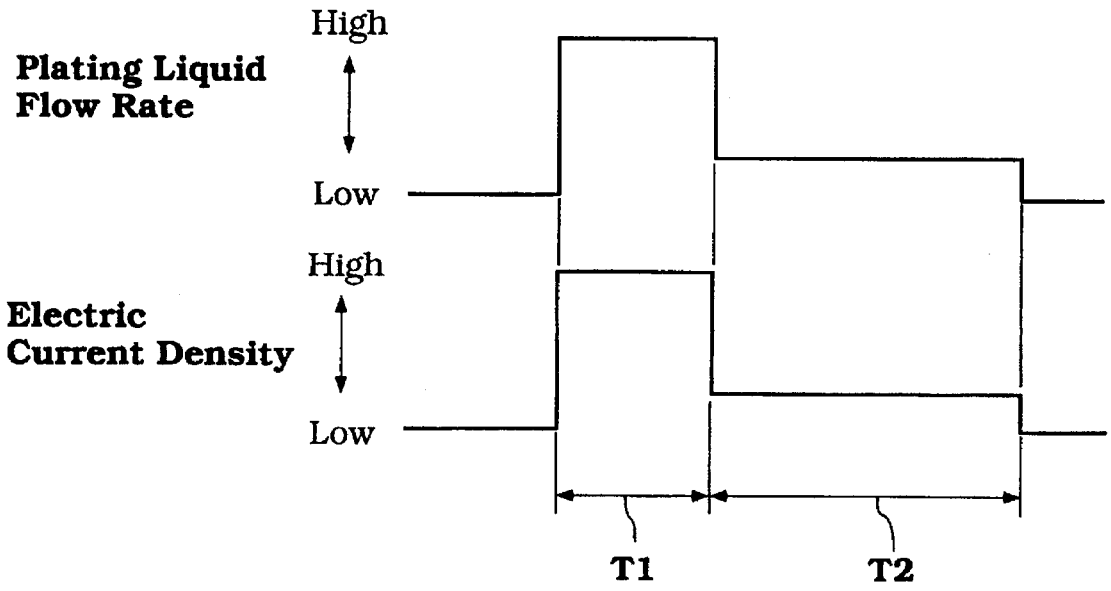
FIG. 6 is a time chart showing one embodiment of control of the plating liquid flow rate and the electric current density in a plating method according to the present invention.
Figure 7:
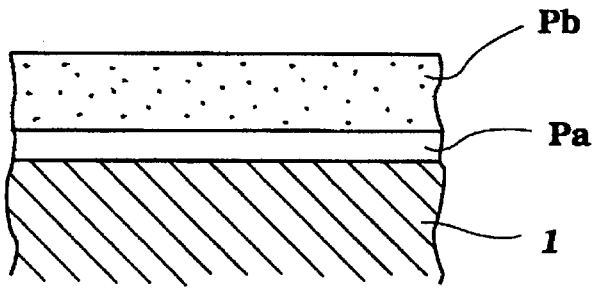
FIG. 7 is a schematic cross-sectional view (a part) showing a plating coating composed of two plating layers formed on the surface of a work based on the time chart of FIG. 6.

In the above apparatus, when the plating liquid flow rate is increased, the electric current density can also be increased, thereby permitting the deposition speed of a plating metal to increase. In the case of composite plating in which a dispersed substance is formed in a plating coating, if the plating liquid flow rate and the electric current density are increased over a certain degree, formation of a dispersed substance tends to be markedly suppressed. By taking advantage of this tendency, this system allows for formation of a plating coating composed of both a composite plating layer which contains a dispersed substance and a base plating layer which contains significantly less dispersed substance, using one kind of plating liquid. In operation, the plating liquid containing a dispersed substance-forming material in the plating bath is supplied to the workstation 2, and circulated in the apparatus. FIG. 6 is a time chart showing one embodiment of control of the plating liquid flow rate and the electric current density in this embodiment. As shown in FIG. 6, during time period T1 (the first time zone) which is counted from the time operation starts, the plating liquid flowing between the electrode 1 and the work 1 is set at a high and constant speed, and a voltage is impressed therebetween in such a way that the electric current density is high and constant during time period T1. During next time period T2<the second time zone) after time period T1, the plating liquid flow rate is reduced in such a way that the flow between the electrode 7 and the work 1 is reduced and constant, and the electric current density is set low and constant during time period T2. In this embodiment, plating liquid flow rate F2 and electric current density E2 during time period T2 are set to form a sufficient amount of a dispersed substance in a plating layer, e.g., a flow rate of approximately 1.5–4.5 m/sec (E2) and an electric current density of 50–200 A/dm$^2$ (F2), and during time period T1, plating liquid flow rate F1 and electric current density E1 are considerably higher than those during time period T2, e.g., a flow rate of approximately 2–6 m/sec (F1) and an electric current density of 150–400 A/dm$^2$ (E1), provided that F1>F2 and E1>E2, so that the amounts of a dispersed substance (e.g., silicon carbide) in the lower plating layer ($SiC_1$) and the upper plating layer ($SiC_2$) can be adjusted to 0.2–4.5% by weight and 1.5–10% by weight, respectively, provided that $SiC_2$–$SiC_1$=1.0% by weight or more. In the case of the combustion car engine blocks, the amount of a dispersed substance in the upper plating layer is preferably 1.5–5.5% by weight, and that in the lower plating layer is preferably 0.5–4.5% by weight. By enlarging the difference between the lower and upper plating layers in the amount of a dispersed substance therein to 1.0% by weight or more, adhesion between the upper plating layer and the surface of a work can be significantly improved without impairing lubricity or fractional properties. In the prior art, the difference was at most 0.5% by weight so that adhesion could not be sufficient. Time periods T1 and T2 are selected depending on the desired thickness of plating layers. During the time period when the plating liquid flow rate and the electric current density are both high, formation of a dispersed substance tends to be suppressed so that a base plating layer containing substantially no or few dispersed substance therein can be formed. During the time period when the plating liquid flow rate and the electric current density are both low, formation of a dispersed substance tends to be promoted so that a composite plating layer containing a sufficient amount of a dispersed substance can be formed. Accordingly, by conducting two treatments consecutively, one of which is at a high plating liquid flow rate and electric current density, the other of which is at a low plating liquid flow rate and electric current density, first a base plating layer is deposited on the surface of the work 1, and second a composite plating layer is deposited thereon. FIG. 7 is a schematic cross-sectional view (a part) showing the plating coating composed of the above plating layers formed on the surface of the work 1, in which the base plating layer Pa is formed first and the composite plating layer Pb is formed thereon. According to this method, the base plating layer Pa and the composite plating layer Pb can both be deposited using a single plating liquid. Although the base plating layer Pa could contain a slight amount of a dispersed substance therein, the amount is practically negligible, and is functionally equivalent to a plain plating layer. Plain plating layer Pa and composite plating layer Pb are normally 2–100 μm and 10–100 μm (prior to honing treatment), respectively.

As a working example (a cylinder of an internal combustion engine block), using the nickel sulfate bath (or the nickel sulfamate bath) containing silicon carbide as a dispersed substance-forming material described in Example 3, first the plating liquid flow rate and the electric current density were set at 4–5 m/sec and 300 A/dm$^2$ (T1=30 seconds; a deposition speed of 60 μm/min), and then those were set at 2 m/sec and 100 A/dm$^2$ (T2=2.5 minutes; a deposition speed of 20 μm/min), respectively. As a result, stacked layers of a base plating layer (a thickness of 30 μm) and a composite plating layer (a thickness of 50 μm) was successfully formed. In particular, the base plating layer contained little dispersed silicon carbide therein (1.5% by weight) as desired, while the composite plating layer contained 4.3% by weight of dispersed silicon carbide. Plating layer Pb (composite layer) having a thickness of 50 μm will be honed afterward down to a thickness of 30 μm, for example. As clearly understood, this plating system is startingly advantageous in terms of productivity, facilities and cost since, in this system, formation of a base plating layer and a composite plating layer can be conducted using the same plating bath, thereby entirely eliminating conventional drawbacks, i.e., transfer of a work between plural plating baths during plating treatment. In particular, since the electric current density is high when a base plating layer is formed, the deposition speed of the plating layer is promoted to a great extent so that the base plating layer can be formed in an extremely short time (5 seconds to 3 minutes, depending on the desired thickness and the amount of a dispersed substance). Incidently, it is possible to simply adjust one of the factors, i.e., the plating liquid flow rate or the electric current density, to deposit both a base plating layer and a composite plating layer.

EXAMPLE 5: Four Layer Plating

Figure 8:
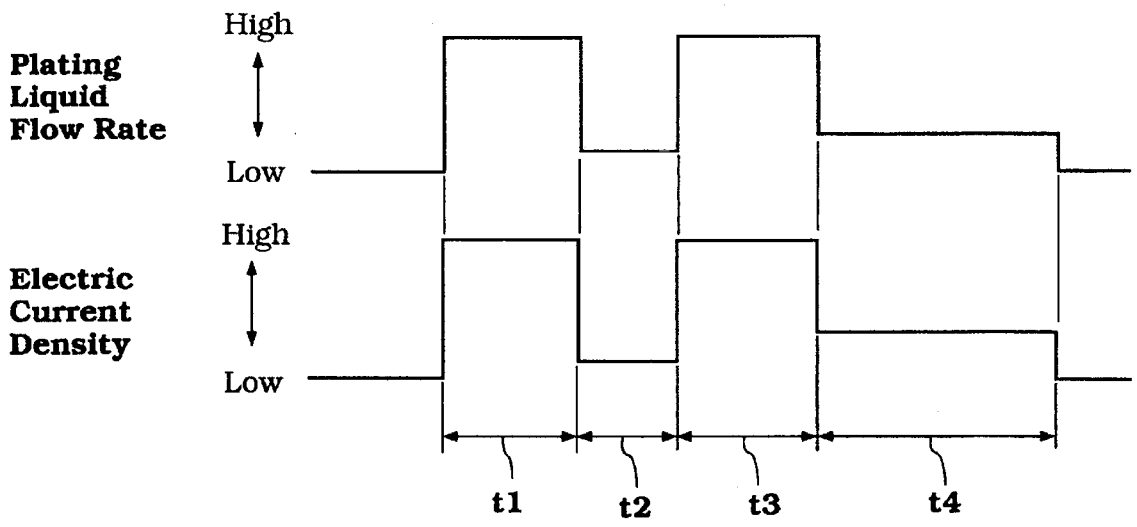
FIG. 8 is a time chart showing another embodiment of control of the plating liquid flow rate and the electric current density in a plating method according to the present invention.
Figure 9:
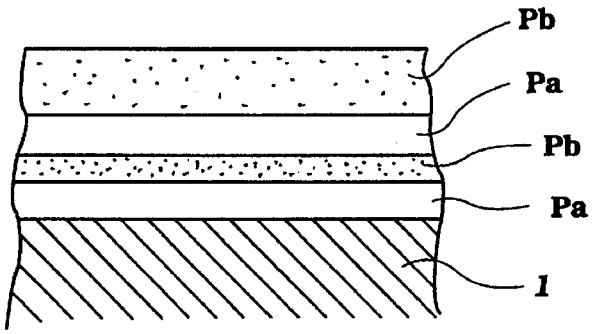
FIG. 9 is a schematic cross-sectional view (a part) showing a plating coating composed of four plating layers formed on the surface of a work based on the time chart of FIG. 8.

If a plating coating composed of more than two plating layers is required in order to improve anticorrosion, for example, it can be achieved by changing the plating liquid flow rate and the electric current density several times corresponding to the desired number of plating layers. FIG. 8 is a time chart showing an embodiment of control of the plating liquid flow rate and the electric current density in order to form a plating coating composed of four plating layers. In FIG. 8, the plating liquid flow rate and the electric current density undergo alternate changes, i.e., high and low, at time intervals, T1, T2, T3 and T4. That is, during time periods T1 and T3, both the plating liquid flow rate and the electric current density are set high, and during time periods T2 and T4, both are set low. Further, both settings during time period T2 are even lower than those during time period T4 so that each composite plating layer can have a different amount of a dispersed substance. The reversed settings, i.e., lower during T4 than during T2, are also possible, depending on the intended use of a work and the desired characteristics. FIG. 9 is a schematic cross-sectional view (a part) showing the plating coating composed of the plating layers formed on the surface of a work based on the time chart of FIG. 8. A plating coating is composed of four plating layers, in which a base plating layer Pa and a composite plating layer Pb are alternately deposited. Plating layers Pa and Pb can have characteristics similar to those described in Example 4, i.e., layer Pa has a thickness of at least 2 μm (a plating coating thickness of approximately 100 μm), layers Pa and Pb contain a dispersed substance of 0.2–4.5% by weight and 1.5–10% by weight, respectively, provided that the difference between layers Pa and Pb in the amount of a dispersed substance is at least 1.0% by weight, preferable 2.0% by weight or more. In such a structure, anticorrosion, for example, is improved while other characteristics such as excellent lubricity and frictional properties are maintained. As clearly understood, it is possible to produce various plating coatings composed of two or more plating layers to meet various requirements by adjusting the amount of a dispersed substance in each plating layer, using a single plating liquid. This is a great advantage of the present invention.

EXAMPLE 6: Plating Layer Having a Graded Distribution of Dispersed Substance

Figure 10:
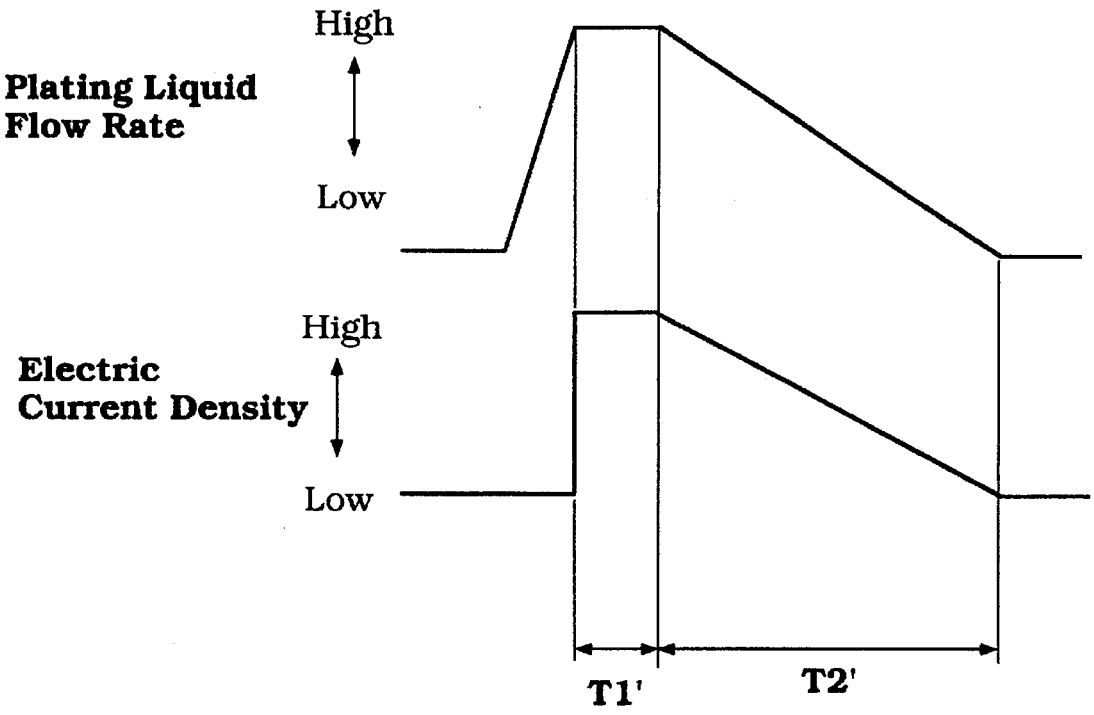
FIG. 10 is a time chart showing still another embodiment of control of the plating liquid flow rate and the electric current density in a plating method according to the present invention.
Figure 11:
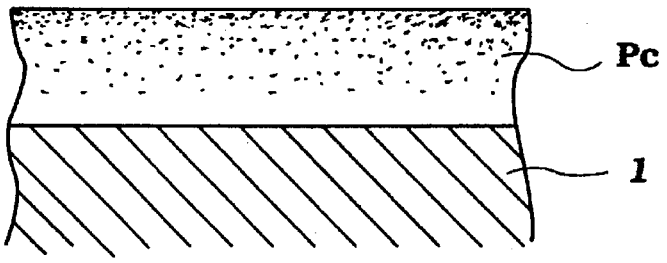
FIG. 11 is a schematic cross-sectional view (a part) showing a plating coating having a graded distribution of a dispersed substance in the outward direction, formed on the surface of a work based on the time chart of FIG. 10.

Based on the present plating system, a plating coating having a graded distribution of a dispersed substance in the outward direction can be readily deposited on the surface of a work. Such a plating coating has excellent adhesion strength, lubricity, frictional properties and hardness, which have never been achieved hitherto. FIG. 10 is a time chart showing an embodiment of control of the plating liquid flow rate and the electric current density for forming a plating layer having a graded distribution of a dispersed substance. FIG. 11 is a schematic cross-sectional view (a part) showing the plating coating (Pc) formed on the surface of a work based on the time chart of FIG. 10. In this embodiment, during time period T1, the plating liquid flow rate and the electric current density are both set high and constant to form a plating layer having substantially no or few dispersed substance on the surface of a work. During the next time period T2 (T1<T2), both are set to gradually lower from the high settings so that the distribution of a dispersed substance will be graded in the outward direction. That is, the amount of the dispersed substance will be high near the outer surface of the plating coating and low near the surface of the work, in which gradation is given to the distribution of the dispersed substance. As in Example 4, the plating layer deposited during time period T1 has preferably a thickness of 2–100 μm, and that during time period T2 has preferably a thickness of 10–100 μm. The amount of a dispersed substance in the upper plating layer near the outer surface should be at least 1.0% by weight more than that in the lower plating layer near the surface of the work. For example, time periods T1 and T2 would be 10 seconds and 3 minutes, respectively. The plating liquid flow rate and the electric current density during time period T1 would be 4–5 m/sec and 300 A/dm$^2$, and those during time period T2 would be gradually reduced to 0.5 m/sec and 30 A/dm$^2$. The thickness of the base plating layer would be 10 μm, and that of the composite plating layer would be 90 μm (a thickness of the plating coating would be 100 μm). The amount of a dispersed substance in the plating coating would be 10% by weight near the outer surface of the plating layer, while that would be negligible near the surface of the work. A graded change in the flow rate and the electric current density can be either linear or curved, depending on the desired characteristics.

The plating method and plating system of the present invention are desirably used in connection with an improved plating system, the details of which are set forth in a U.S. patent application entitled "Plating Liquid, Plating Method and Plating Cylinder," Ser. No. 08/299,838, filed on Sep. 1, 1994 (claiming priority from Japanese Patent Application No. 218753, filed Sep. 2, 1993), which is hereby incorporated herein by reference.

It will be understood by those of skill in the art that numerous variations and modifications can be made without departing from the spirit of the present invention. Therefore, it should be clearly understood that the forms of the present invention are illustrative only and are not intended to limit the scope of the present invention.

I claim:

1. A method for forming a plating coating having a non-homogeneous distribution of a dispersed substance, consisting essentially of the steps of:

(a) placing a hollow cylindrical electrode having an end inside a work having a cylindrical inner surface, wherein an inner passage of plating liquid is formed inside said hollow cylindrical electrode, and an outer passage of plating liquid is formed between said hollow cylindrical electrode and said cylindrical inner surface of said work, said inner passage and said outer passage being communicated via said end of said hollow cylindrical electrode;

(b) permitting a plating liquid containing a dispersed substance-forming material to flow at a plating liquid flow rate of 1.0 to 7.0 m/s through said outer passage and said inner passage via said end of said hollow cylindrical electrode;

(c) impressing a voltage between said work and said electrode to give an electric current density of 20 to 400 A/dm$^2$ therebetween; and (d) after initiating deposition of a plating coating on said cylindrical inner surface of said work in steps (b) and (c), changing the plating liquid flow rate, or the plating liquid flow rate and the electric current density, at intervals or continuously, the change being such that the plating liquid flow rate is decreased to increase the amount of a dispersed substance, while the plating liquid flow rate is increased to decrease the amount of a dispersed substance, to a degree enough to produce an outwardly non-homogeneous distribution of said dispersed substance in the plating coating formed in steps (b) and (c) and in this step with a difference in the distribution of at least 1.0% by weight.

2. The method according to claim 1, wherein, in step (d), at least the plating liquid flow rate is changed at intervals to form the plating coating composed of plural plating layers, each having a different amount of the dispersed substance therein.

3. The method according to claim 1, wherein, in step (d), at least the plating liquid flow rate is continuously changed while the plating coating is being formed to gradually change the amount of the dispersed substance in the outward direction.

4. The method according to claim 1, wherein, in step (d), the plating liquid flow rate is changed and the electric current density is constant.

5. The method according to claim 1, wherein, in step (d), the plating liquid flow rate and the electric current density are both changed.

6. The method according to claim 1, wherein, in step (d), at least the plating liquid flow rate is decreased and increased alternately.

7. The method according to claim 1, wherein at least the plating liquid flow rate in step (d) is set lower than the plating liquid flow rate in step (b), where the amount of the dispersed substance near the outer surface of the plating coating is greater than that near the surface of the work.

8. The method according to claim 7, wherein the plating liquid flow rate in step (d) and the electric current density in step (c) are high enough to prevent formation of the dispersed substance in the plating coating near the surface of the work, and the plating liquid flow rate and the electric current density in step (d) are low enough to promote formation of the dispersed substance near the outer surface of the plating coating.

9. The method according to claim 8, wherein the plating liquid flow rate is 2–6 m/sec in step (b), the electric current density is 150–400 A/dm$^2$ in step (c), and the plating liquid flow rate and the electric current density are 1.5–4.5 m/sec and 50–200 A/dm$^2$, respectively, in step (d), provided that the plating liquid flow rate and the electric current density in step (d) are lower than those in steps (b) and (c).

10. The method according to claim 9, wherein said plating liquid further contains phosphorus.

11. The method according to claim 1, wherein said plating liquid is a nickel plating liquid, and said dispersed substance-forming material is silicon carbide.

12. The method according to claim 1, wherein, in step (a), the flowing plating liquid is circulated in a system.

13. The method according to claim 1, wherein said work is a cylinder of an internal combustion engine block.

14. A method for forming a plating coating having an outwardly non-homogeneous distribution of a dispersed substance, comprising the steps of:

(a) permitting a plating liquid containing a dispersed substance-forming material to flow at a plating liquid flow rate of 2–6 m/sec between a surface of a work to be plated and an electrode;

(b) impressing a voltage between said work and said electrode to give an electric current density of 150–400 A/dm$^2$ therebetween; and (c) after initiating deposition of an inner plating layer on the surface of said work in steps (a) and (b), reducing the plating liquid flow rate and the electric current density, at intervals or continuously, in the range of 1.5–4.5 m/sec and the range of 50–200 A/dm$^2$, respectively, to form an outer plating layer where the inner plating layer deposited in steps (a) and (b) and the outer plating layer deposited in step (c) have an amount of a dispersed substance of 0.2–4.5% by weight and 1.5–10% by weight, respectively, provided that the outer plating layer contains the dispersed substance at least 1.0% by weight more than that of the inner plating layer.

* * * * *